US009318811B1

(12) United States Patent
Fluhler

(10) Patent No.: US 9,318,811 B1
(45) Date of Patent: Apr. 19, 2016

(54) METHODS AND DESIGNS FOR ULTRA-WIDE BAND(UWB) ARRAY ANTENNAS WITH SUPERIOR PERFORMANCE AND ATTRIBUTES

(76) Inventor: Herbert U. Fluhler, Huntsville, AL (US)

( * ) Notice: Subject to any disclaimer, the term of this patent is extended or adjusted under 35 U.S.C. 154(b) by 503 days.

(21) Appl. No.: 12/386,231

(22) Filed: Apr. 15, 2009

Related U.S. Application Data

(60) Provisional application No. 61/124,270, filed on Apr. 15, 2008.

(51) Int. Cl.
*H01Q 21/00* (2006.01)
*H01Q 21/26* (2006.01)

(52) U.S. Cl.
CPC ..... *H01Q 21/26* (2013.01)

(58) Field of Classification Search
CPC ..... H01Q 21/00
USPC ..... 343/767, 770, 771, 795
See application file for complete search history.

(56) References Cited

U.S. PATENT DOCUMENTS

| | | | | |
|---|---|---|---|---|
| 5,389,939 A | | 2/1995 | Tang | |
| 5,557,291 A | * | 9/1996 | Chu et al. | 343/725 |
| 5,786,792 A | | 7/1998 | Bellus | |
| 5,894,288 A | * | 4/1999 | Lee et al. | 343/770 |
| 5,949,382 A | * | 9/1999 | Quan | 343/767 |
| 6,166,701 A | | 12/2000 | Park | |
| 6,219,000 B1 | | 4/2001 | McWhirter | |
| 6,404,377 B1 | | 6/2002 | Lee | |
| 6,559,810 B2 | * | 5/2003 | McCorkle | 343/795 |
| 6,600,453 B1 | | 7/2003 | Hadden, IV | |
| 6,900,770 B2 | | 5/2005 | Apostolos | |
| 7,057,570 B2 | | 6/2006 | Irion, II | |
| 7,474,262 B2 | | 1/2009 | Alland | |
| 7,652,631 B2 | * | 1/2010 | McGrath | 343/767 |
| 7,764,236 B2 | * | 7/2010 | Hill et al. | 343/702 |

OTHER PUBLICATIONS

Kyo-Hwan Hyun, Kyung-Kwon Jung, Ki-Hwan Eom; Sweet Spot Control of 1:2 Array Antenna using a Modified Genetic Algorithm; Systemics, Cybernetics and Informatics; vol. 5-5; KO.

Y. Yang, Y. Wang. A. E. Fathy; Design of Compact Vivaldi Antenna Arrays for UWB See Through Wall Applications; Progress in Electromagnetics Research, PIER 82, 401-418, 2008.

* cited by examiner

*Primary Examiner* — Dameon E Levi
*Assistant Examiner* — Hasan Islam
(74) *Attorney, Agent, or Firm* — Mark Clodfelter

(57) ABSTRACT

A array of fixably interconnected planar elements equally spaced and orthogonally oriented, that is ultra wide band with a low operating frequency, exhibits steerability in both azimuth and elevation and is capable of dual polarization. The configuration of the array, having a 1:2 ratio of elements to feed lines, allows the implementation of two oppositely driven 50 ohm coaxial feed lines to feed into a single 94 ohm element without the need for custom components or impedance transformers.

14 Claims, 14 Drawing Sheets

<500 MHz to >4.5 GHz Array Module

*Table 1. FDTD Simulations Performed To Optimize The Connected Array*

| Name | Backplane | Thickness | Free Vars | Operating Band VSWR < 3 |
|---|---|---|---|---|
| half1 | no | 31.75 mm | 2 | DC – ~4.5 GHz |
| half2 | yes | 39.69 mm | 2 | ~ 1 – 5 GHz |
| half3 | yes | 59.53 mm | 2 | ~0.78 – 5 GHz |
| half4 | yes | 89.30 mm | 2 | ~0.61 – 5 GHz |
| half5 | yes | 89.30 mm | 5 | ~0.6 – 5+ GHz |
| half6 | yes | 119.06 mm | 5 | ~0.5 – 4.8 GHz |

METHODS AND DESIGNS FOR ULTRA-WIDE BAND(UWB) ARRAY ANTENNAS WITH SUPERIOR PERFORMANCE AND ATTRIBUTES

This invention was developed in whole or in part with Government support under contract N68936-07-C-0056. Accordingly, the U.S. Government has Small Business Innovative Research (SBIR) Data Rights in this invention.

FIELD OF THE INVENTION

This invention relates to a connected array antenna system and method, and more particularly to an ultra-wideband (UWB) array antenna with a low operating frequency and an improved feed-to-element aspect ratio.

BACKGROUND OF THE INVENTION

Array antennas are arrangements of antenna elements working in together in concert to provide higher power handling, higher gain, higher directivity with lower sidelobes than is generally possible with singular antenna elements or even non-array arrangements of antenna elements. Additionally, they permit dynamic directional steerability under electronic control which is also an attribute not generally found in singular antenna element instantiations. Array antennas have numerous vital applications in radar imaging, target tracking, sensor data collection, and precision location and have more recently found application in numerous new high technology applications such as medical imagining, RF and optical astronomy, and Ultrasound.

Although array antennas have numerous wonderful attributes for numerous applications, they almost universally suffer from three common limitations or maladies. First, is the limitation on low frequency operation due to element cutoff, second is the limitation on high frequency operation due to grating lobe formation, and third is the resultant small limited bandwidth resulting from these two other limits. It is a key goal of the present invention to solve all three of these most challenging problems all at once.

The first limitation on low frequency cutoff is due to the finite size of the antenna elements making up the antenna array. The elements making up an array are still limited by the laws of antennas physics to a low frequency cutoff equating to when the physical size of the element is about a third of the low frequency cutoff wavelength (lambda/3). This is a fairly hard law to break and is quantified by the McClean-Chu-Harrington limit and their several variations. To the extent that antenna elements might be made smaller, they will invariably be of tower radiation efficiency which is antagonistic to most array performance specifications.

The second limitation concerns the generation of grating lobes if the wavelength used becomes shorter than twice the inter-element spacing (lambda/2). Grating lobes are almost universally bad because they channel power in directions other than the intended direction. This both puts signal power where it might do harm (alerting an enemy to a radar's presence for example) and at the same time robs power from the desired direction by diverting it to other unintentional directions The confluence of these two limitations above result in a lower frequency limit defined by the element cutoff, and high frequency limit defined by the formation of grating lobes, the usable frequencies in between define the usable bandwidth. Given that the low frequency cutoff of the elements is about a third of a wavelength and the high frequency formation of grating lobes occurs at about half a wavelength, this limits the bandwidth of an array antenna to something less than about 40% bandwidth, with 30% being a more typical number due to the restrictions imposed by other related limitations.

Although these may sound like reasonable bandwidth fractions based on past antenna and array requirements, new technology advancements are requiring octave and even decade bandwidth from antennas, and they are also required to retain all the other typical performance metrics such as being highly efficient, high power handling, low cost, producible, etc. The current array antenna simply does not support these new requirements and therefore a new advancement is needed in the area of wideband high power electronically steerable array technology. It is therefore the goal of this invention to address this need with a new array technology that can actually meet all these stressing new requirements simultaneously while also being low cost, rugged and producible.

With these applications, such an antenna would be superior to alternate antennas and antenna configurations for a variety of reasons including its ability to share bandwidth spectrum with other users, its immunity to multi-path fading, and its manifestation of both clear and improved signal reflection.

Still, while antenna array advantages generally outweigh disadvantages, there are downsides. For instance, previous arrays have required resistive loading (e.g., R cards) to insulate against radiation resulting from back reflection which would otherwise degrade the Return Loss (VSWR). The present invention minimizes back reflection, thus minimizing the need for lossy loading treatments.

Further, traditional array antennas, because of an after the fact difference between their feed and antenna impedance, require impedance transformers, which can add significant loss to the system, limit bandwidth, limit power handling, introduce phase and frequency distortion, increase the space consumed by the antenna, increase cost and reduce reliability. By controlling impedance organically within the antenna proper through the explicit design of the antenna architecture, contours, shaping and structure, the present invention creates less of a mismatch between the feed and antenna impedances, resulting in both a better voltage standing wave ratio (VSWR) match and superior space management. In addition, the ability to actually design the impedance of the antenna to be what ever value the designer might choose, allows one to design the antenna feed impedance to be a common value (e.g. 50, 75 or 100 ohms) enabling the use of low cost readily available commercial of the shelf (COTS) components, eliminating the traditional array need for expensive custom components, thus decreasing cost and time to market.

SUMMARY OF THE INVENTION

A general objective of this invention is to produce an improved array antenna, which overcomes disadvantages of the prior art discussed above. A further objective is to design an antenna array with very large fractional bandwidth (octaves, decades or more) resulting in Ultra-Wide Band (UWB) operation with low pristine phase and frequency response degradation. It is also an objective to design a UWB antenna array that is electrically small with a high efficiency (typically better than 90 percent radiation efficiency) at a very low operating frequency for its physical size. Another objective is to design an antenna array that exhibits steerability in both azimuth and elevation over very wide angle without the production of grating lobes. Producing an antenna array for ultra wide band use over the subject band with dual polarization capability and extremely low axial ratio with excellent cross polarization isolation (better than −30 dB) is another objective. In addition, it is an objective of this invention to produce said antenna array with inexpensive readily available parts, materials and processes such as those employed with conventional Printed Circuit Board (PCB) technology. Moreover, it is an objective of this invention to create such an array that is rugged, lightweight, compact and low cost.

The present invention, in one embodiment, consists of an array of fixably interconnected planar elements substantially equally spaced and substantially orthogonally oriented. This orientation yields a regular array of substantially volumetrically equal cells with cell sides formed by portions of the interconnected planar elements. These interconnected planar elements are comprised of a substantially resilient dielectric material. An additional four-sided planar element at least equal in height and width to the greatest height and width of the array is fixably connected to the interconnected planar elements. This additional four-sided planar element, having evenly spaced apart through holes interspersed throughout its surface, with a plurality of these holes occupied by coupling members with conductive properties, each coupling member having a female receptacle for a edge connector and a female receptacle for a coaxial cable connector, constitutes the back of the array.

To a top layer of the dielectric material of both the front and back of each volumetrically equal cell side a printed patch of conductive material is applied. The patch of conductive material on each side consists of two planar horn shapes, the splayed separation of which is similar to but not necessarily identical to the shape of a Vivaldi planar horn. The planar horn shapes may be on the same side of any non-conductive substrate used in their construction, or they may be on opposite sides in antipodal fashion. The key requirement is that their electrical feeding is arranged such that the source polarity from one feed is connected via a respective planar horn petal conductor into the sink polarity of an adjacent, neighboring planar horn petal conductor.

Each planar horn shape constitutes an antenna element which is registered by and centered on the feeding arrangement to the element In one embodiment the planar horn shape extends the entire length of one cell side and is characterized by both a petal section, with one straight edge and one convex curved edge that tapers to a point at the front of the cell, and a tail section that extends rearward, progressively narrowing until it reaches the back of the cell. The petal has a width that is never greater than one side of a cell in a configuration where only one feed per unit cell is used to achieve a higher feed impedance near 188 ohms, and a width of never greater than one half of one side of a cell in a configuration where two feeds per unit cell is used to achieve a lower feed impedance near 94 ohms. In an alternate embodiment the nearest two halves of neighbor planar horns are both on the same side of the non-conductive substrate if one is used. In either embodiment an "airline" construction could be employed to eliminate the substrate material altogether.

Throughout the array these planar horn shapes are arranged in two distinct configurations. In order to achieve dual polarization, these two configurations are always orthogonally oriented in each cell. In one configuration the straight edges of two planar horn shapes are immediately adjacent, so that one distinct shape is created. The rearward section of this configuration forms a closed parabolic-like shaped planar cavity. In another configuration, two planar horn shapes printed on the same side of the same cell are oriented so that the convex curved edges of the shapes face each other. In this second configuration the space between each planar horn shapes is variable. Opposing faces of a cell side each contain alternate configurations of the planar horn shape. This shape improves high frequency performance and impedance matching with the feed lines.

Throughout the array, cell sides, comprised of numerous planar horn shapes (antenna elements), meet and cross through one another forming a junction with four 90 degree angles. Each of these junctions comprises the crossing of two elements in each polarization. In combination, these elements, electromagnetically connected and mutually coupled to all the other elements, form a connected array. This coupling increases the aperture seen by each element to that of the entire array allowing each element to use the entire aperture for radiation. This then allows each element to radiate efficiently at a frequency much lower than that which would be permitted by the spatial extent of each element singularly, and in fact the low frequency cut off is then defined by the lowest frequency of efficient operation having a wavelength that is about three times larger than the aperture of the connected array in any polarization

DETAILED DESCRIPTION OF THE DRAWINGS

By way of contrast, an exemplary embodiment of a highly optimized UWB antenna element is illustrated in FIGS. 1A-14. Such an element would be far superior to most that might be employed in array antennas in so far that its bandwidth and low frequency operation are superlative for a singular antenna element. In fact this element was the result of a first attempt to produce the desired array. Because this antenna element could singularly find numerous applications it is disclosed herein both as part of the current invention and also to demonstrate its disadvantages when compared to the connected array later in this disclosure.

Figure 1A:
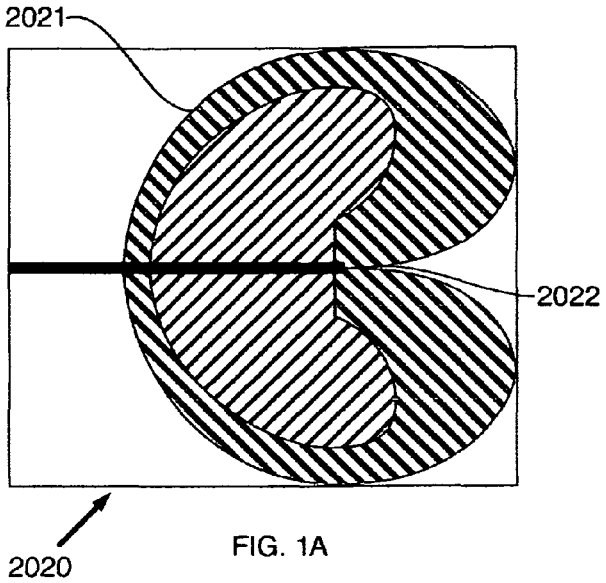
FIG. 1A shows a Hyper-Wide Band (HWB) cycloid dipole antenna.

The antenna element of FIG. 1A is called a Cycloidal element due to its obvious appearance to the cycloidal shape of geometry or alternatively as a Hyper-Wide Band (FMB) element because of its extended bandwidth performance versus other UWB antenna elements. The concept of design is to co-locate an electric dipole element with a magnetic loop element into a combined element that combines the behavior of both. The design of FIG. 1A combines a UWB elliptic dipole with a UWB loop antenna element by extending the electrical path of the dipole from the far tips of the dipole into a connecting loop circuit. In effect this gives the current somewhere to go other than reflecting off the tips of the dipole back into the feed where it manifests as Return Loss (VSWR).

When a dipole is combined with a loop, a preferential lobe appears out one direction and a null out the other due to the manner in which the fields generated by each add up. In many cases this additional directionality may be desirable, although in some applications (such as steered arrays which are to be steered far off boresight) it is not. Regardless, the null out the backside of the element is almost always a desirable attribute except in applications requiring omni-directional antennas. But for directional antennas the lower the backlobe of the element, the lower the impact on VSWR when the invariable backplane is added to the antenna or array to complete the suppression of backwards radiation.

There is an additional advantage from the cycloid HWB element design. The aforementioned connecting loop provides a further conducting path for the current to travel if it has not radiated, thereby providing additional opportunity for the current to radiate. This then reduces the Return Loss because there is less power left to produce Return Loss, and this then lowers the operating frequency of the HWB element by about 10%, and with some simple impedance matching it can be lowered further to perhaps as much as 30% lower frequency than what would be possible for the same VSWR from an elliptic dipole.

Unfortunately, during design and testing, various Hyper-Wide Band (HWB) elements exhibited a resonant mode at about 2.1-2.3 GHz when fed by an Ultra Wide Band (UWB) balun, but not when fed with a simple coaxial feed—such as an SMA connector printed circuit board (PCB) mount connector. The unbalanced feed of the SMA connector rotated the pattern; in this manner masking a resonant mode null occurring on boresight. The balanced feed from the balun brought the null on boresight. The null was subsequently found to be caused by the polarity of the current in the back loop being out of phase with the feed current, and displaced by exactly half a wavelength at about 2.1-2.3 GHz. To break the resonant mode, various design approaches for HWB elements were put to test. The designs endeavored elimination of the null simply through redesign of a printed circuit board (PCB) layout. The main idea of the improved HWB element designs is to break the destructive interference between the back loop current and the planar slot current that is the source of the null. The destructive interference is supported by the separation between the back loop and the planar slot being about half a wavelength at the null frequency, changing the separation; thus affects the coherence that causes the null.

FIG. 1A shows one of the tested HWB elements, wherein the element is arranged in an elliptical dipole configuration. HWB elliptical dipole 2020 has a back loop 2021 that portrays a softened contour near feed 2022. Element 2020 performs well at high frequencies, and exhibits a lower and acceptable return loss for the peak below the null frequency.

Figure 1B:
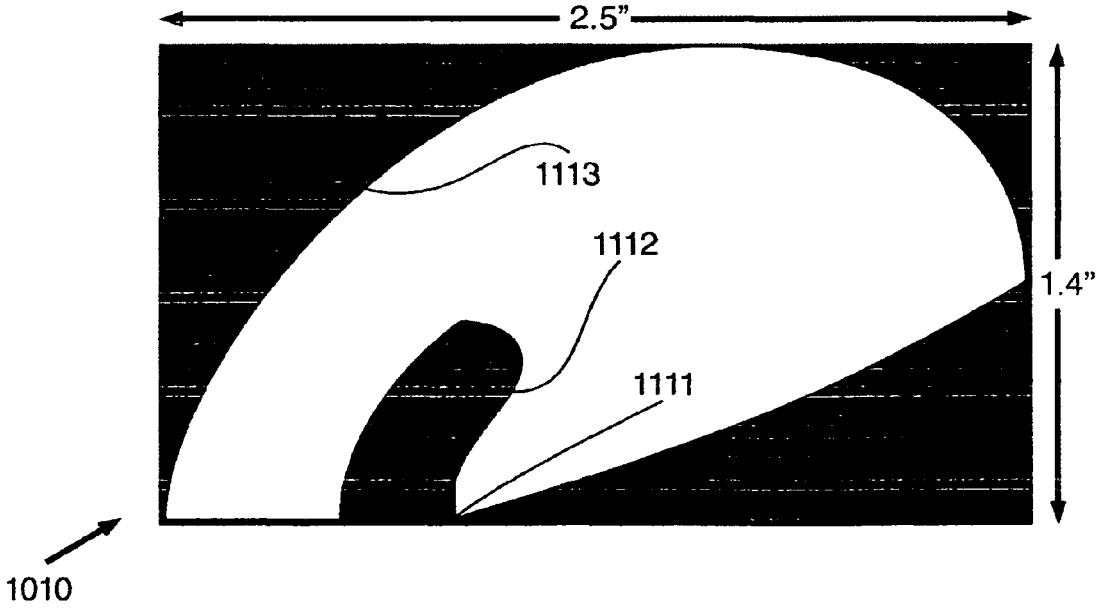
FIG. 1B shows a HWB cycloid optimized antenna element.
Figure 1C:
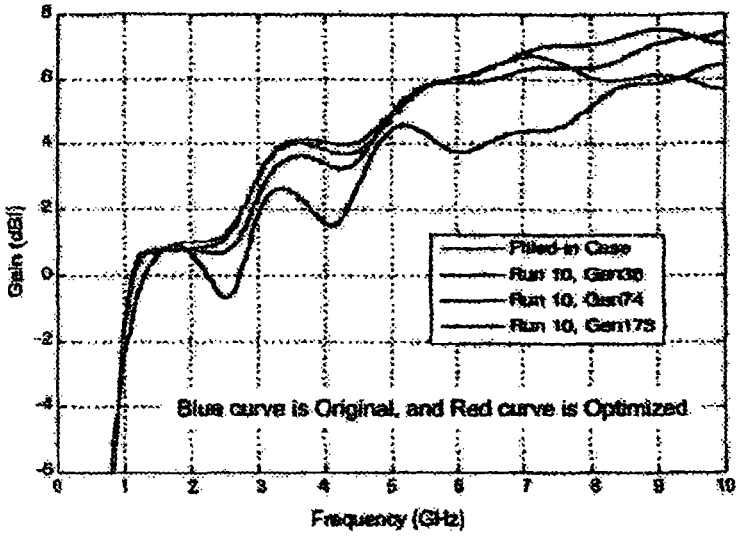
FIG. 1C shows the performance of HWB cycloid optimized antenna element.

Turning to FIG. 1B, a revised HWB antenna element whose design eliminates the null occurring on boresight, 1010, is shown. HWB element 1010 is disposed along a PCB layout. A throat section 1112 is brought substantially deep into the interior of HWB element 1010, and is terminated near back loop 1113. Additionally, feed point portion, 1111, is brought towards a portion of back loop 1113. The performance data of optimized HWB antenna element 1010 is shown in FIG. 1C. As shown in the gain plot, the null between 2-3 GHz is substantially eliminated in the optimized design. It is also shown that the element gain increases with frequency. For some applications this might be desirable, but for a beam-steerable array there is a need for a hemi-omni type of pattern.

Despite the superlative performance of the optimized HWB element disclosed in FIG. 1B, many antenna any applications are still left wanting even with this arguably superior element. The key issues are as described above, namely not enough bandwidth to meet ever more demanding application requirements, the formation of grating lobes at the high end of the band, not a low enough frequency response on the low end of the band and not a low enough element gain to support wide angle electronic steering with an array using these elements. Since the HWB element represents arguably a pinnacle of UWB antenna element design, it becomes apparent that a new paradigm is required to meet the more stressing new requirement for arrays.

The new paradigm promulgated in this disclosure is a concept called a connected array wherein mutual coupling between the radiating elements of the array permit the array to act as a unified collective instead of a disjointed assemblage of separate isolated parts as in a traditional array antenna. The mutual coupling between radiating elements permits each of the elements to electrically see the entire aperture of the array as its radiating structure, thereby substantially increasing the effective aperture of each element, and this in turn allows every element to radiate efficiently at much lower frequencies than otherwise would be possible by the element's dimensions alone. However, in designing such a connected array, the fundamental issue is how to perform the mutual coupling.

There are principally three ways in which antenna elements might be coupled together: reactively, conductively and a combination of both. Dr. Munk (OSU ESL) has promulgated the use of capacitively coupled elements for Frequency Selective Surfaces (FSS) which could be considered a cousin of the connected array. Although capacitive coupling could be used in the current invention (and in reality it is used by default to some extent through the shaping of the planar horn petal geometries), there are two fundamental problems with capacitive coupling. First, a capacitor is by definition an open at zero frequency. Therefore, this means that any connected array made exclusively with capacitive coupling between elements will disconnect at lower frequencies. But this is just when one would want the connection between elements to be most active so as to flow current over the whole aperture for maximum radiation efficiency. Therefore we conclude that capacitive coupling is counter productive to the operation of low frequency connective arrays and should be avoided at least when low frequency is a requirement. The second problem with capacitive coupling is that it is highly reactive. As such, it is hard to control so as to give a desirable reactance at all the feed points that would either not harm or possibly even help the Return Loss of the array.

This latter point of capacitive reactive coupling also applies to inductive reactive coupling, except to the other extreme in frequency. With inductive coupling the low frequencies will connect fine but the high frequencies will be disconnected by the inductive coupling. However, note that if the amount of inductance is not excessive, this behavior is not particularly damaging to the overall performance of the array as a function of frequency. The low frequency behavior will be such that the array radiates as a whole, and at high frequency the elements will still radiate efficiently and independently. At higher frequencies, current flow between radiating elements is less than at lower frequencies, but this current flow still causes high frequency radiation, which fills in the gaps of radiation between elements. In so doing, this current flowing between elements eliminates the discrete discontinuities (steps) in phase between the elements. It is these steps in phase that cause grating lobes. Eliminate the steps and you eliminate grating lobes! Therefore, it can be seen that one of the key attributes of a properly designed connected array will be the elimination of grating lobes, at least in the connected current planes.

In both cases of either reactive coupling or capacitive coupling deleterious effects are seen to emerge. However, some reactive coupling is likely required to some degree for optimizing the match to the feeds of the antenna over the very wide band widths sought after in the objectives of this invention. But in general this is a very difficult balancing act of nonlinear functions to produce another non-linear function that produces the good match over a wide frequency band that we might desire. The conclusion then is that conductive coupling, or perhaps more accurately, real, ohmic, radiative and characteristic impedance coupling are the types of couplings we should seek to produce a connected array with the desired properties.

Given that the type of coupling should center on conductive coupling, there then still needs to be a load in the circuit or else the feed points will short together and that defeats all the objectives intended. Indeed there is really only one load that we want in an antenna, and that is the radiation resistance of the antenna: all other loads are either dissipative or distortive and are almost universaliy undesirable except possibly in some arcane specific situations and applications. So we desire to have the radiation resistance of the antenna as the only load on the array, and in so doing we will also want to optimize the feed impedances of the array elements to achieve maximum power transfer into space with minimum Return Loss. The problem then is to compute what the impedance of the radiation resistance is, and to then modify the feed impedances to provide a good match. Conversely, one could consider defining a desirable feed impedance (50, 75 and 100 ohm impedances are common) and then endeavor to somehow design the array to provide those loads from the radiation resistance to the feeds.

The fundamental aspect for solving this impedance design problem for the array is to realize that the impedance of free space is 377 ohms per square. The square size is unimportant, as what affects the impedance is both the electric (E) and magnetic (B) fields in the manipulation of the square shape reflected through the well known defining equation $Zo=|E|/|B|$. As an example, if the aforementioned square shape is made narrower in the B field direction, by a factor of two; then the impedance within will be higher by a factor of two. If the square is made narrower, by a factor of two, in the E field direction; then the impedance will be lower by a factor of two. By changing the aspect ratio between the E and B directions of the unit cell containing one feed, the impedance of that feed may be theoretically changed to any arbitrary value of impedance chosen. Given that regular arrays need to have integer multiples of aspect ratio, only discrete increments of impedance can be implemented easily using a uniform gridding typically employed in an array. However, that can be allayed by the use of irregular spacings in arrays, so it is not overtly a physically limiting factor just a somewhat more difficult geometry, layout design and engineering problem.

Figure 2A:
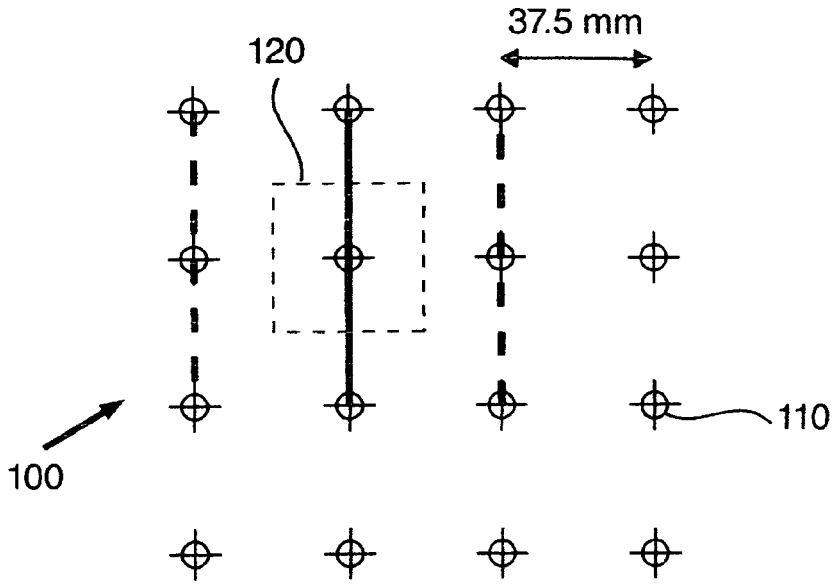
FIGS. 2A-2B show the geometry and feed impedance of a connected array with a 1:1 aspect radio.
Figure 2B:
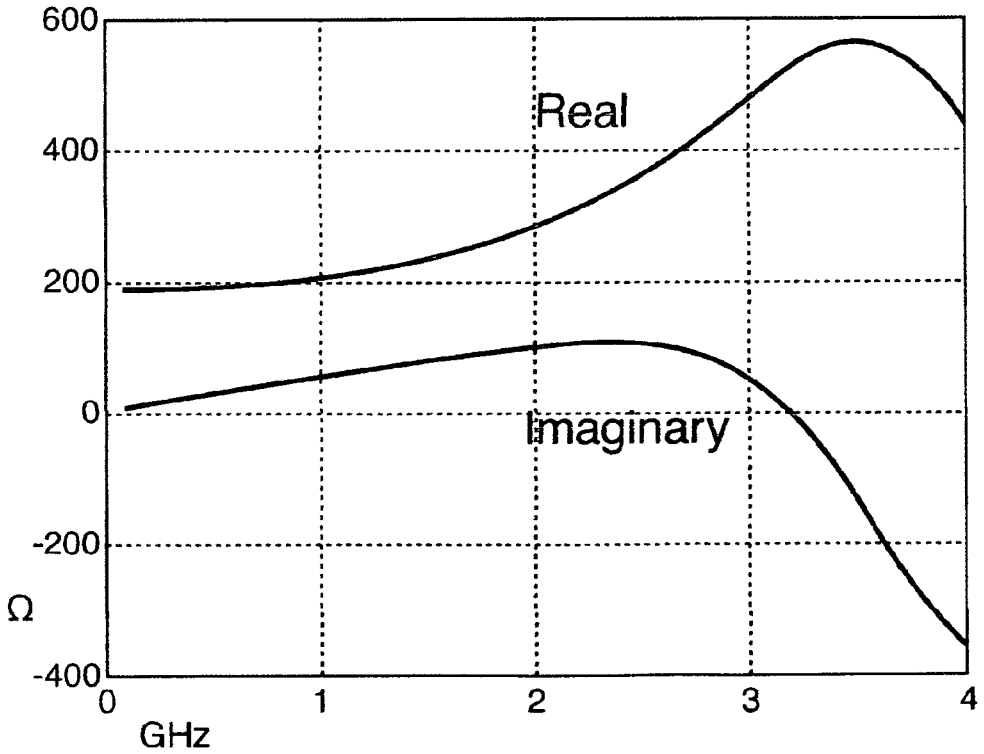

The impact on feed impedance of various aspect ratios of the unit cells of the connected arrays are shown on FIGS. 2A-2B. Referring to FIG. 2A, a single polarization thin wire connected array 100 with an aspect ratio of 1.1 is shown. The aspect ratio is governed by the manner in which unit cell 120 is connected to neighboring unit cells. Thin wire connected array 100 has a plurality of feed points 110, where each feed point 110 is connected to an adjacent feed point in a rectangular grid with a spacing of 37.5 mm (1.5 in) and where feed points 110 are all in phase. Further, the plurality of feed points 110 are comprised of at least one positive terminal and at least one negative terminal which are co-aligned to each other, with a positive terminal of one feed point connected to the negative terminal of an adjacent feed point. In FIG. 2B, the real and complex feed impedance in ohms as a function of frequency from 0 to 4 GHz is shown. In this example, the unit cell size was selected to be a half wavelength at the highest frequency of interest (4 GHz) so as to avoid any possibility of grating lobe formation. With one feed per unit cell the feed impedance tends to 188 ohms at low frequency. A significant reference to a fundamental physical principle is portrayed by connected array 100, as 188 ohms is exactly half of the impedance of free space. Note that the impedance of free space being 377 ohms per square refers to a propagating plane wave moving in one direction at the speed of light in free space. However the wire array of FIG. 2 admits two plane waves to emanate from this array, one emitted on each side of the array. As such, there are then two plane waves emitting from the same connected array, each with an impedance of 377 ohms per square. These two waves present their impedances in parallel to the connected array, and as is well known in the art of electrical engineering, any two impedances in parallel combine through the inverse addition law 1/21+1/22−1/2t where 21 and 22 are the impedances that are in parallel with each other and Zt is the net total impedance seen at their joined node (in this case the connected array). In this way we see that the impedance load on the array per square of the array will be half of the 377 free space impedance when the unit cell is completely square, in perfect agreement with the low frequency performance shown from the electromagnetic simulations. At higher frequencies, the local structure of the feeds and their connection hardware become of the same order as wavelength at those higher frequencies, and then the local capacitance and inductance of such structures can dominate the reactive behavior of the unit cells. Ideally one can then do some detailed design of the local sub-unit cell structure to optimize the impedance performance at the higher frequencies. Alternatively, one can simply make the unit cell smaller and then the performance at any desired specific frequency can be made to trend to the predictable global connected array performance valued shown for the lower frequencies. In this way through conscientious manipulation of the aspect ratio of the unit cell as well as its size relative to the highest frequency of desired operation, a very well behaved and readily characterizable UWB connected array with custom designed feed impedances may be designed out of simple geometric shapes such as wires, strips. To accommodate the higher frequencies where performance starts to deteriorate, use of conventional UWB antenna element shapes such as Bowties and elliptic petals will improve the higher frequency performance without adversely affecting the low frequency performance.

Figure 3A:
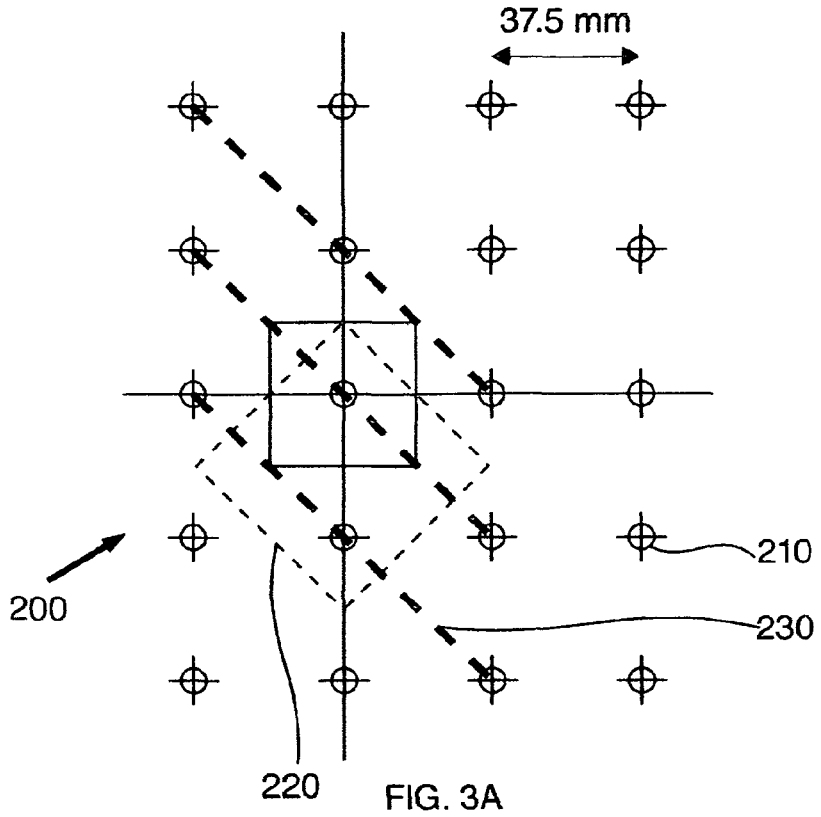
FIGS. 3A-3B show the geometry and feed impedance of a connected array with a 2:1 aspect radio.
Figure 3B:
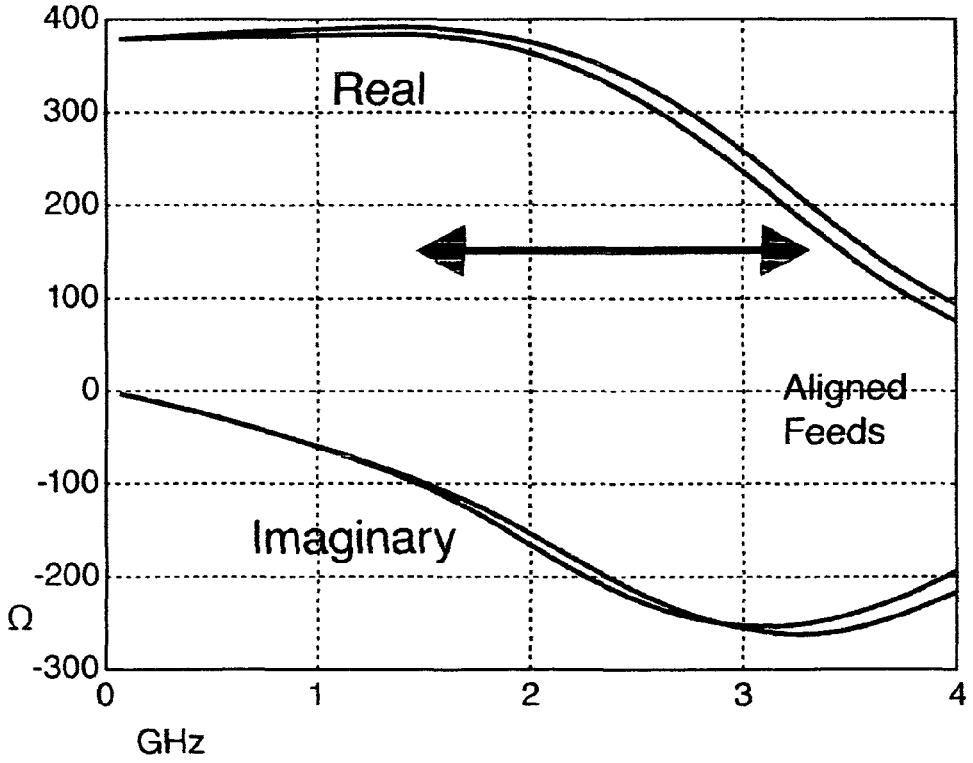
Figure 4A:
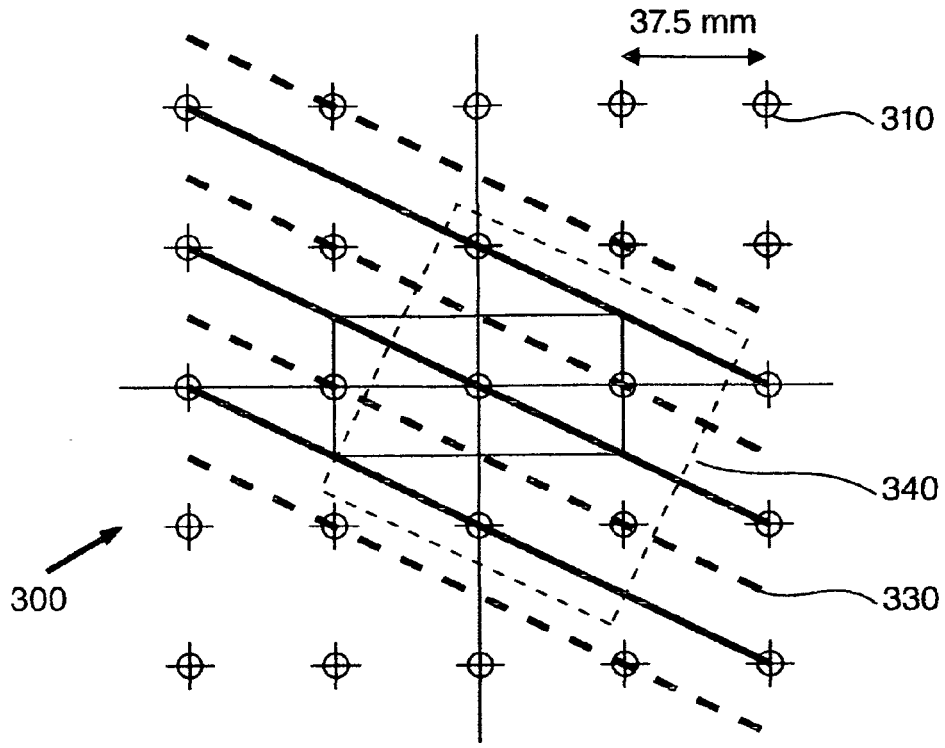
FIGS. 4A-4B show the geometry and feed impedance of a connected array with a 5:1 aspect radio.
Figure 4B:
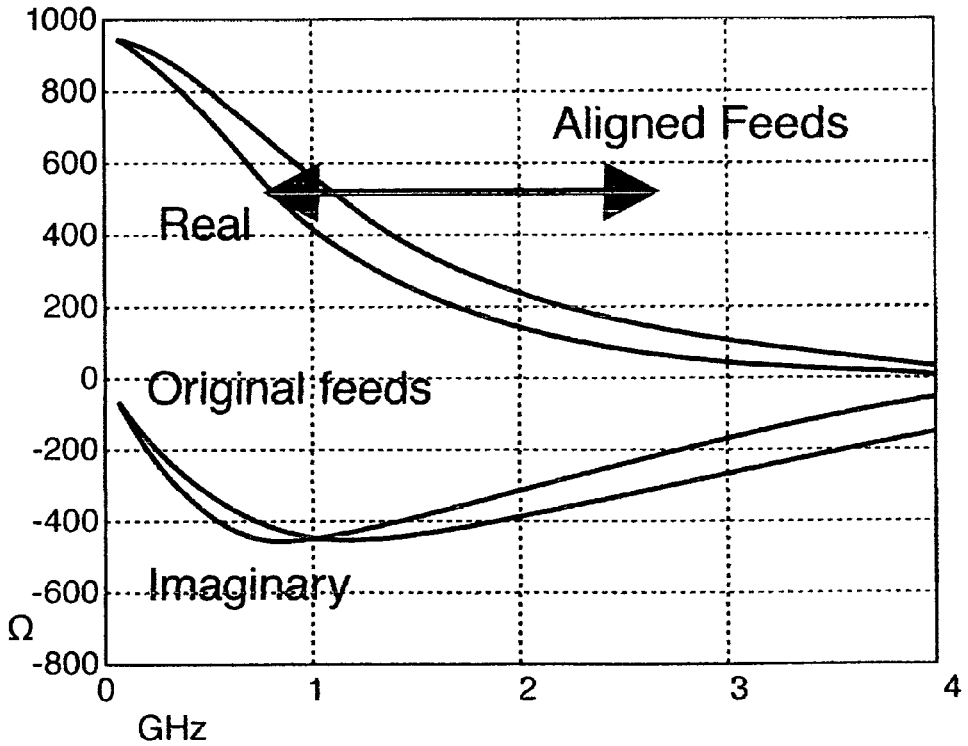

Referring to FIG. 3A, thin wire connected array 200 portrays as aspect ratio of 2:1. Unit cell 220 is connected to neighboring feed points along diagonal line 230. FIG. 3B shows that in this particular embodiment the impedance tends to 377 ohms at the low frequencies, and it drops off at high frequencies. Matching of this antenna may be accomplished by means of a series inductor or shunt capacitor. In FIG. 4A, an aspect ratio of 5:1 is analyzed. Thin wire connected array 300 shows unit cell 340, in which feed points 310 are connected to neighboring feed points along diagonal line 340. This type of arrangement will cause the feed impedance to be about 940 ohms at low-frequency, as shown my FIG. 4B. At the frequency of 4 GHz, the impedance becomes very small. Antenna matching in this case, appeared to be more challenging than with the previous embodiments.

Examination of the results obtained from the various aspect ratios indicate a trend as (aspect ratio)*188 ohms, or alternately as ($n^{d}2$+1)*188 ohms; where n is the number of elements skipped. Further analyses of the results showed that either a 188-ohm feed or a 377-ohm feed impedance could be used. The reason why the impedance trends to 188 ohms is because there is 377 ohms per square on each side of the conducting elements; hence 377 ohms in parallel with 377 ohms effectively becomes 188 ohms. In the case of a one sided element like a waveguide slot array, then the impedance would be 377 ohms instead of 1S8 ohms. Further, the ground plane is far away enough from the conducting elements, so as not to cause much impact, until the wavelength gets long enough. Given that scenario, the ground plane becomes electrically close to the conducting elements, and then it tends to short one side. Through proper element design geometry, high frequency feed impedance can be designed to match low frequency impedance with high flexibility. Specifically, by using a 1:2 ratio layout of feeds (as opposed to the 2:1 of FIG. 3A), the feed impedance becomes (188 ohms)/2=94 ohms. The present configuration of the array, having a 1:2 ratio of elements to feed lines, allows the implementation of two oppositely driven 50 ohm coaxial feed lines to feed into a single 94 ohm element without the need for custom components or impedance transformers. Additionally, it allows the connected army of the invention to be designed using standard Commercial Off-the-Shelf (COTS) 50 ohms components for beamforming and steering.

Figures 5, 6:
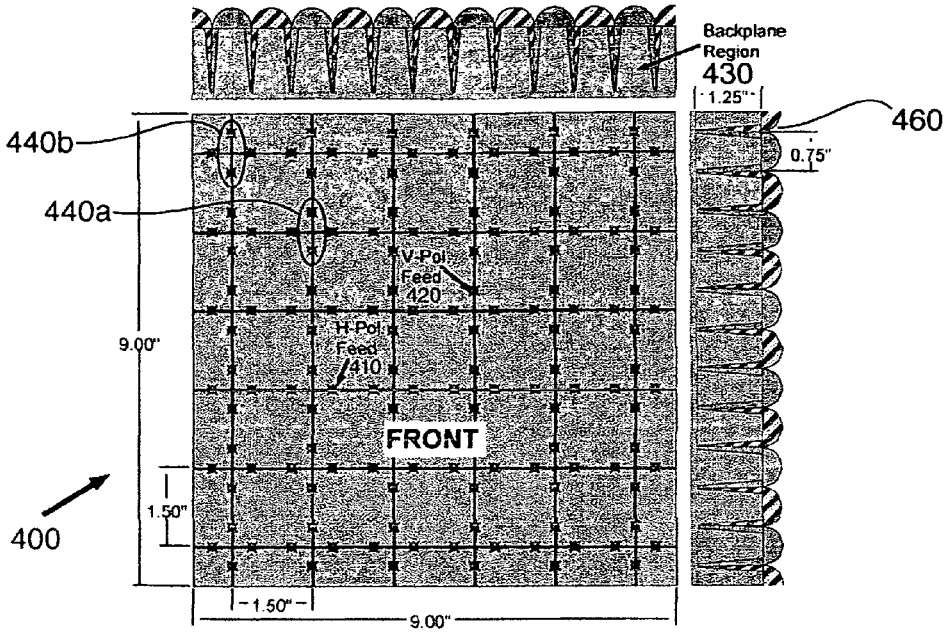
FIG. 5 shows a dual-polarization planar hornlette connected array.
FIG. 6 shows a comparative table for performing connected array optimization.

The embodiment of FIG. 5 shows a dual polarization planar hornlette connected array, 400, prototype. The radiating elements are computer-designed planar horns using Genetic Algorithm optimized Finite Difference Time Domain (FDTD) code. The elements in each polarization 410, 420 are laid out separately on a 1:2 aspect ratio which according to previously discussed analyses should result in a array impedance of 94 ohms. The backplane region 430 would nominally contain a small stack-up of a couple of computer designed layers of R cards (not shown) which will reflect most of the residual backward radiated power back out the front of the array. Element 440*a*, is one of 32 centered-elements fed with eight each 4-way combiners, and later combined with an 8-way combiner. Remaining elements around the periphery, 440*b*, are all terminated because the peripheral elements would otherwise see half of their load as an open, resulting in an undesirable reflection. Further, array 400 is assembled together with a mortise-and-tenon-joint design. The planar hornlettes are etched on Printed Circuit Board (PCB), and these cards are milled with slots on 1.5 inches spacing to form a mortise and tenon arrangement so the cards slip together to form an egg-crate structure. Furthermore, the 1.5 inches spacing between cards prevent the occurrence of grating lobes up to a frequency of 4.5 GHz. The spacing of 0.75 inches between feed points 460, instantiates the previously discussed 1:2 ratio within the 1.5 inches PCG board. The backplane region 430 of the card have UWB baluns with SMA edge connectors (not shown) that alternate their polarity in concert with the alternating copper cladding of the planar hornlettes.

Figure 7A:
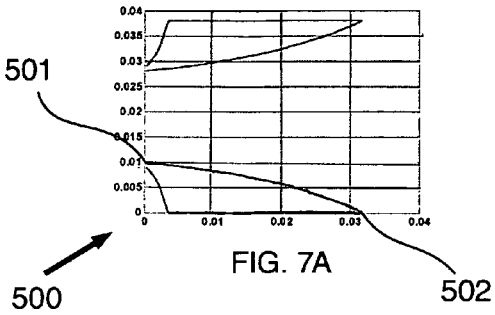
FIGS. 7A-7E show geometry, dimension and performance of the half1 design.
Figure 7B:
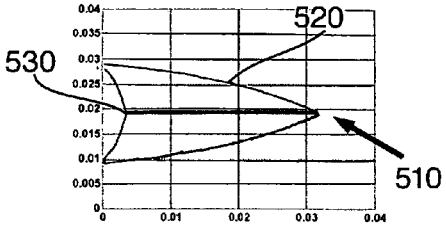
Figure 7C:
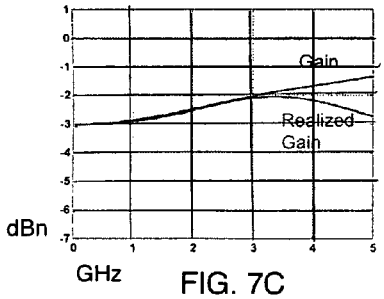
Figure 7D:
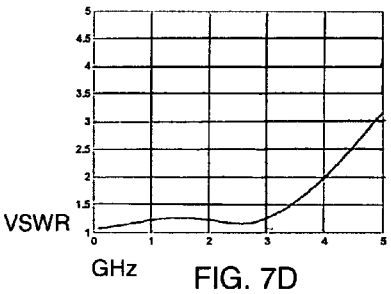
Figure 7E:
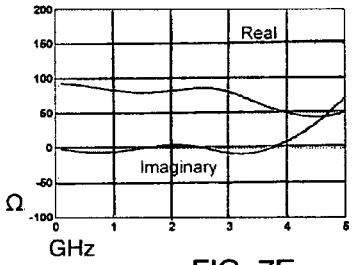

Several array thicknesses were modeled in the table of FIG. 6. The simulation names are in the first column, "NAME". The second column, "BACKPLANE", indicates whether a backplane was modeled or not. The third column, "THICKNESS", is the planar horn throat length, or alternately the thickness of the array from the backplane forward. The "FREE VARIABLES" column indicates the number or free variables that were optimized. The last column, "OPERATING BAND VSWR", shows the usable bandwidth resulting from the simulation. These simulations provided with an unit cell, half3, that met most of the design requirements—including a desirable smaller size—, as shown in FIGS. 8D-8F. In FIG. 8D-8E, the selected design shows an improved normalized gain and VSWR, with only a 1 dB dip in gain around 2 GHz. Additionally, the FIG. 8F shows a 100 ohm centrally-concentrated impedance variation, suggesting a better overall match. Referring back to FIG. 6, the initial design, half1, was a starting point design without a backplane to compare to the other proposed designs. As shown in FIG. 7A, the planar horn shape, 500, disposed along the front side of a PCB card, is 3.175 cm (1.3 in) from the end of the tail 501 to the forward tip 502 and its width is 0.10 cm at the widest part of the petal. As shown in FIG. 7B, two planar horn shapes 510 are disposed along the back side of a PCB card with convex curved edges 520, opposing each other and the two planar shapes, when touching, create parabolic cavity 530. Since half1 design does not have a backplane, the normalized gain goes to −3 dBn, as shown in FIG. 7C. The gain, is therefore, seen to be isotropic all the way down to 0 Hz, and starts to manifest a couple of dB gain enhancement from the horn taper at higher frequencies. The realized gain tracks the normalized gain until about 3.5 GHz at which point the VSWR degrades to 3 at 5 GHz, as shown in FIG. 7D. This loss is due to reflections at the high frequencies where the local details of the petal, 501, structure starts to dominate over the connected array collective behavior. As shown in FIG. 7E, there is a decrease in real impedance down to about 50 ohms, causing a mismatch with the 100 ohms feed.

Figure 8A:
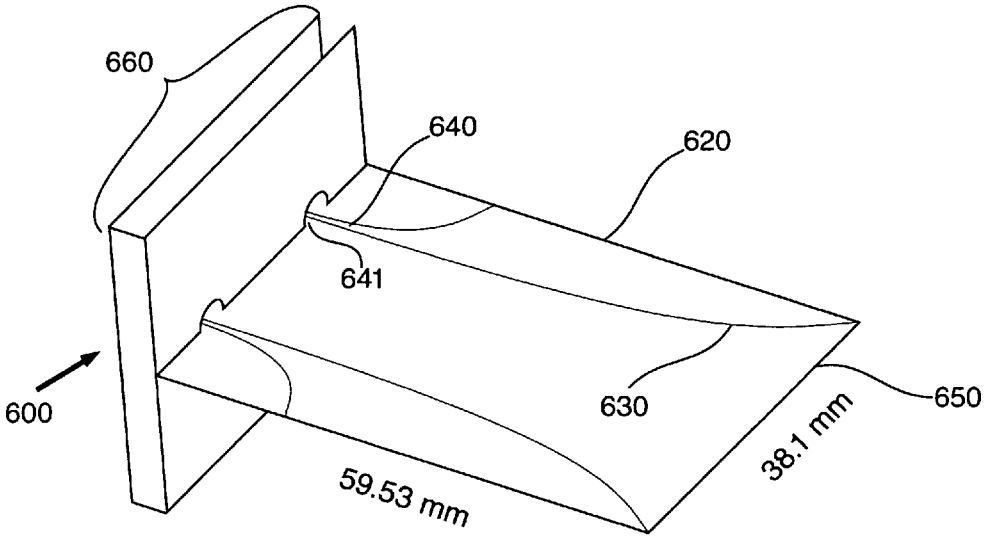
FIGS. 8A-8F show geometry, dimension and performance of the selected unit cell design.
Figure 8B:
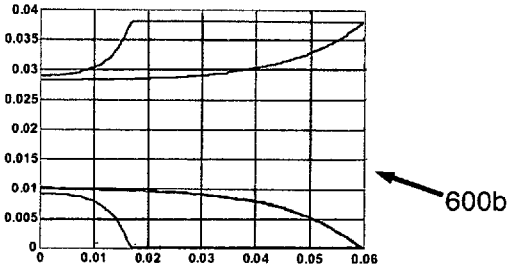
Figure 8C:
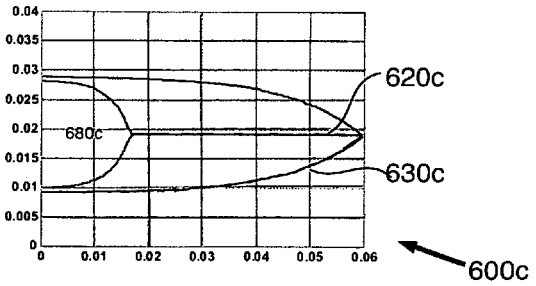
Figure 8D:
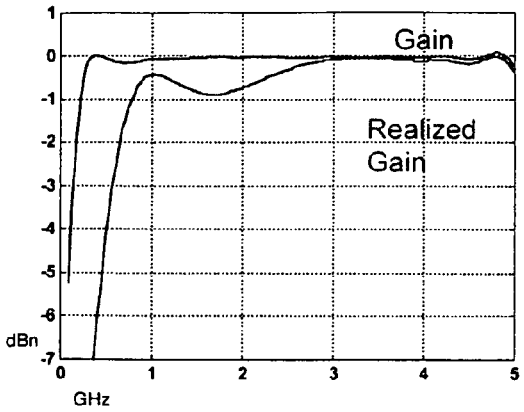
Figure 8E:
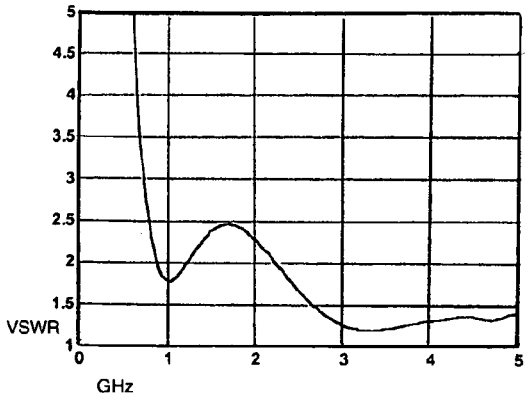
Figure 8F:
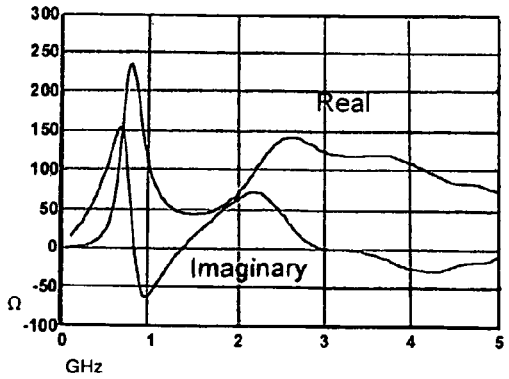
Figure 10:
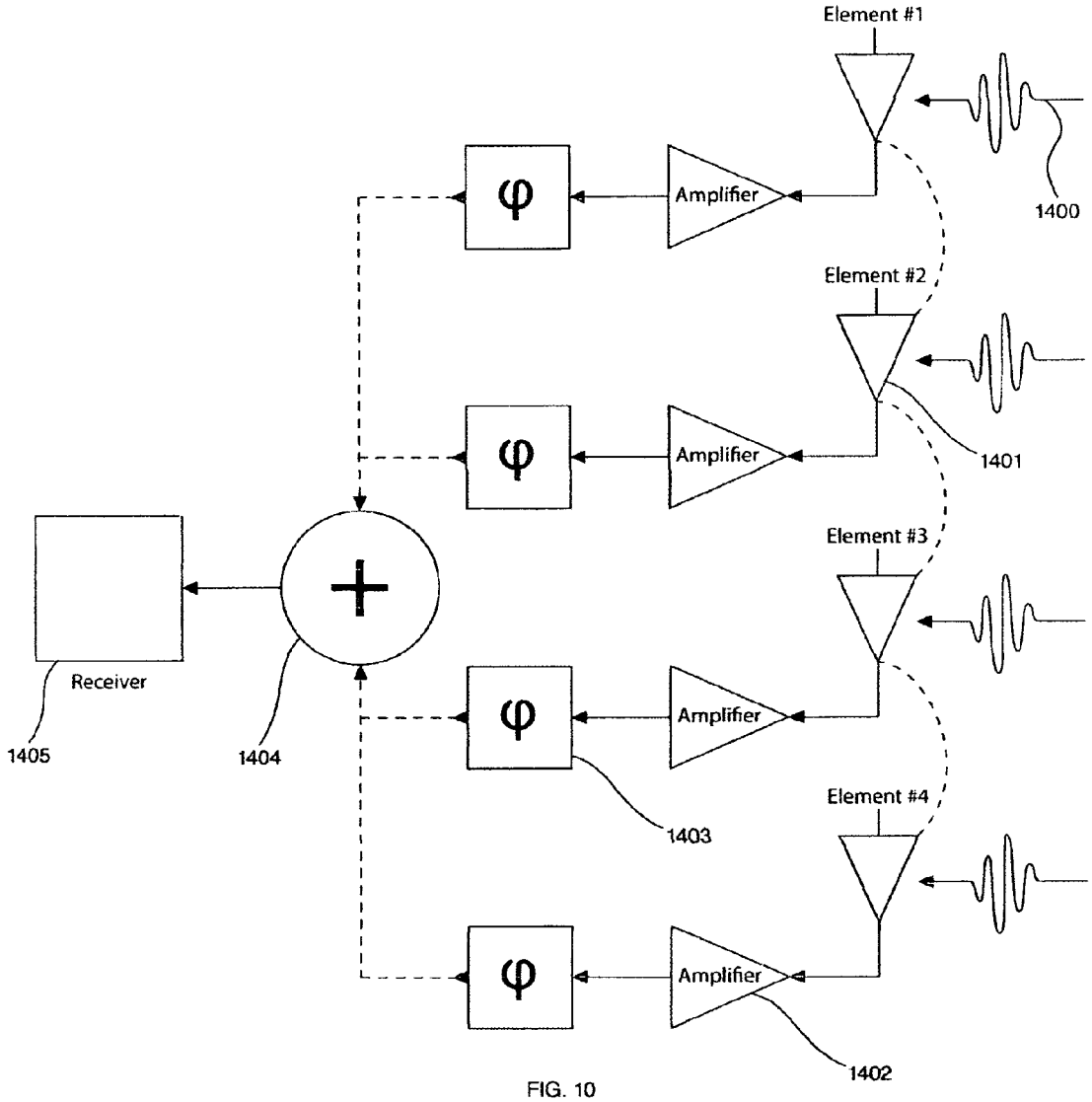
FIG. 10 shows an schematic view of the array with amplifiers added.

Referring to FIG. 8A, each planar horn shape 600 is characterized by a petal 610 having both a straight edge 620 and a convex curved edge 630 that tapers toward the straight edge 620 culminating in a point at the front of the array 650, and a tail 640 that extends from one side of the petal to the back of the array 660. As shown in FIG. 8B, the planar horn shape, 600*b*, disposed along the front side of a PCB card, is 5.953 cm (2.34 in) from the end of the tail to the forward tip and its width is 0.95 cm (0.37 in) at the widest part of the petal. In the alternative, both the height and width are variable. For instance, the width could be as great as half the width of one cell side. Further, because current flows along the edges of these planar horn shapes, much of the copper or other conductive material in their makeup, could be eliminated in alternate embodiments. As shown in FIG. 8C, two planar horn shapes 600*c* are disposed along the back side of a PCB card with convex curved edges 630*c*, opposing each other. Where found in the completed array, this configuration is printed in the center of a cell side so that straight edge, 620*c*, is 0.95 cm (0.37 in) from the cell side. Alternately, this could extend the complete width of a cell. The two planar shapes, when touching, create parabolic cavity, 680*c*, with a width of 1.8 cm (0.71 in) and a height of 1.7 cm (0.67 in). In a different embodiment, this cavity could vary in width and height with the size of the planar horn shape. In an alternate embodiment, a planar horn shape having a hole near the forward point of the petal can lower the Voltage Standing Wave Ratio (VSWR). As shown in FIG. 8A, the tail 640 of the planar horn shapes extends backward, 641. These tails, as shown in FIG. 6B, end in a SMA edge connector. The SMA edge connector couples with an adapter that in turn couples with a coaxial feed line (not shown). Furthermore, UWB impedance transformers/baluns (not shown) are provided to feed each point individually. In one embodiment, splitters (not shown) feed the aforementioned impedance transformer/baluns and beam steerage phase or time delay units can be placed at the entry or exit of the balun to steer the beam if desired. In a preferred embodiment of the invention, as shown in FIG. 10, signals 1400 are received by antenna elements 1401 which each operably connected to amplifiers 1402. Amplifier 1402 is operably connected to a phase shifter element 1403, the received signals are then combined by means of combiner 1404 which is operably connected to a receiver 1405 (or signal source). The use of amplifiers at each point —either before or after a balun—provide with an active array which has the property of completely eliminating all losses that typically impact array performance. This is obtained by collocating the amplifier on position right to the array feeds, so no losses except those of radiating into space are introduced.

Figure 9:
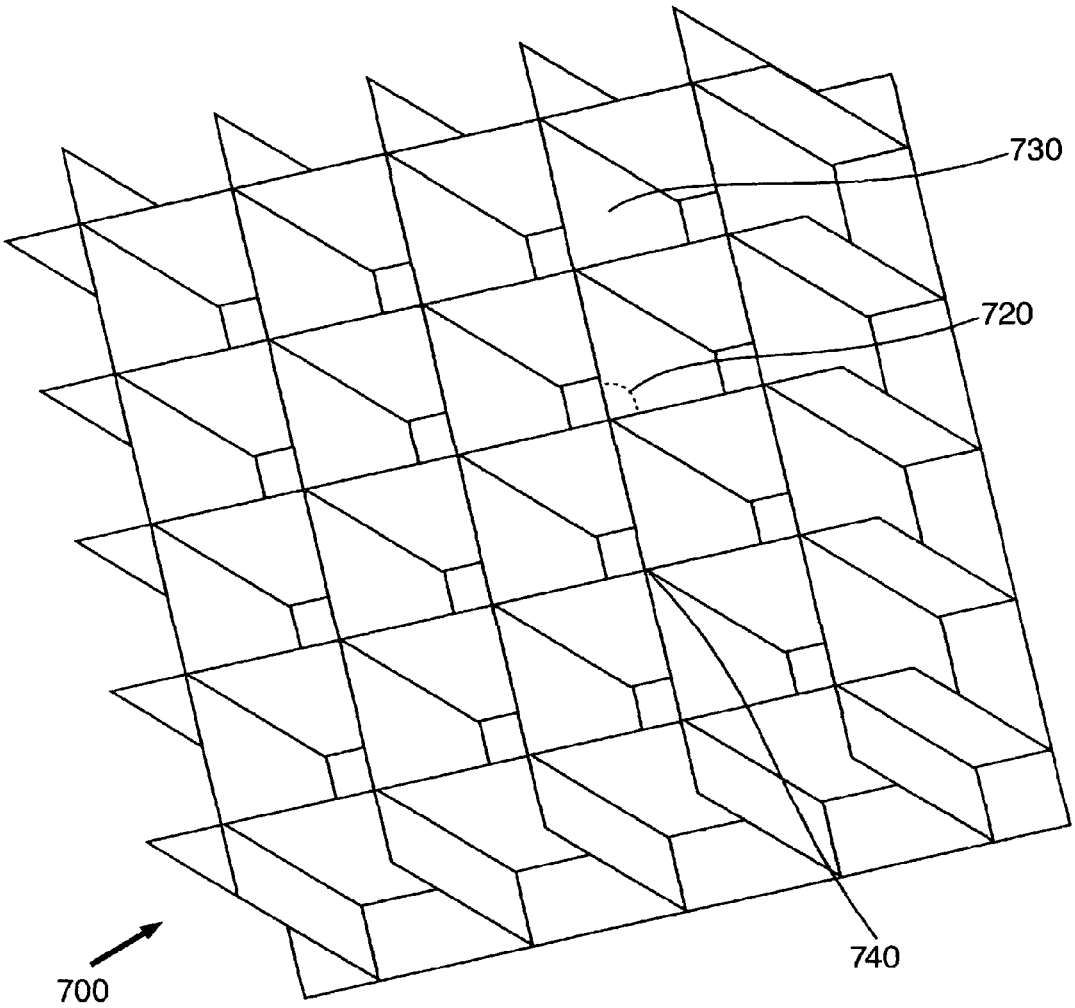
FIG. 9 shows a three dimensional front view of the dual polarized array utilizing the selected unit cell design.
Figure 12:
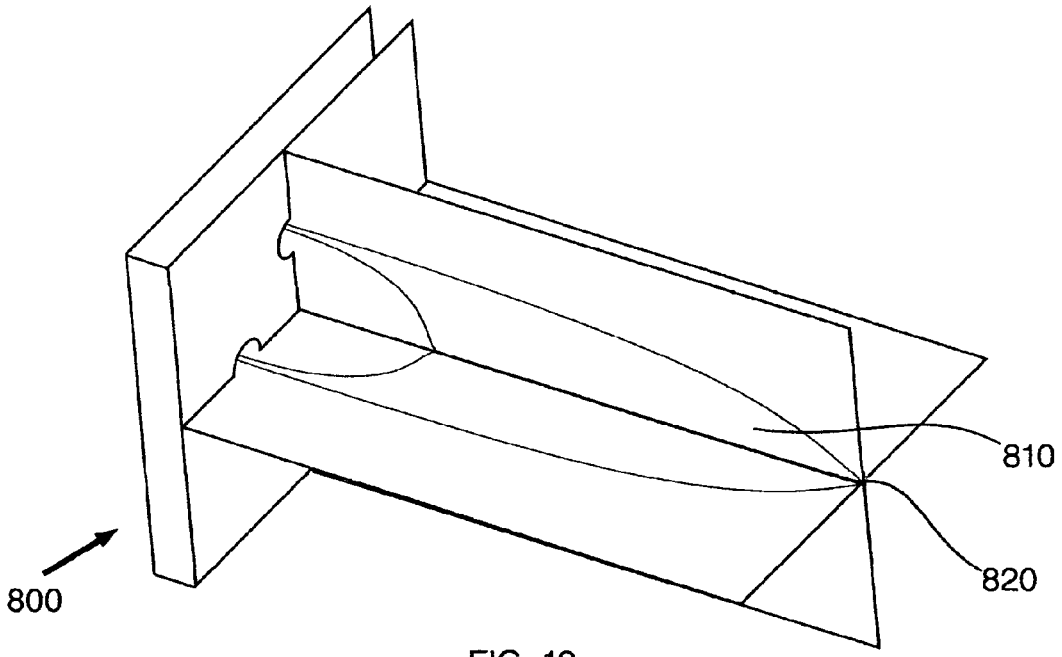
FIG. 12 shows a three dimensional front view of the dual polarized unit cell design.

As shown in a three dimensional front view in FIG. 9, the connected array, 700, comprises a plurality of parallel and perpendicular planar members, each of which is standardized Printed Circuit Board (PCB). In the alternative, any non-conductive material such as plastic or a composite could be used. These planar members comprise integrated petals (not shown) and are mechanically joined at numerous mortise and tenon junctures, 740. Each of the four 90 degree angles diverging from the juncture center point forms two sides of a cell, for example 720. Each planar member, as exemplified by member 730, is 19.05 cm (7.5 in) in length and 6 cm (2.36 in) in width. Alternately, the length and width can be optimized to a variety of frequency ranges. The array consists of four horizontally oriented planar members and four vertically oriented planar members or a 8×8 feed array. The aforementioned 8×8 feed array arrangement provides the dual polarization desired effect. Each polarization has a separate planar member 800 with integrated petals 810, 100 ohm baluns (not shown) and appropriately designed mortise and tenon arrangement 820; as shown by FIG. 12. In another embodiment, the number of vertical and horizontal planar members could be 10, 12, or more. Each intersection of horizontal and vertical planar members, for instance 710, results in a junction. In some embodiments, the center point of this junction, for example 740, could be replaced with a metal rectangular solid extending the width of the PCB or some other rigid material extending likewise.

Figure 13A:
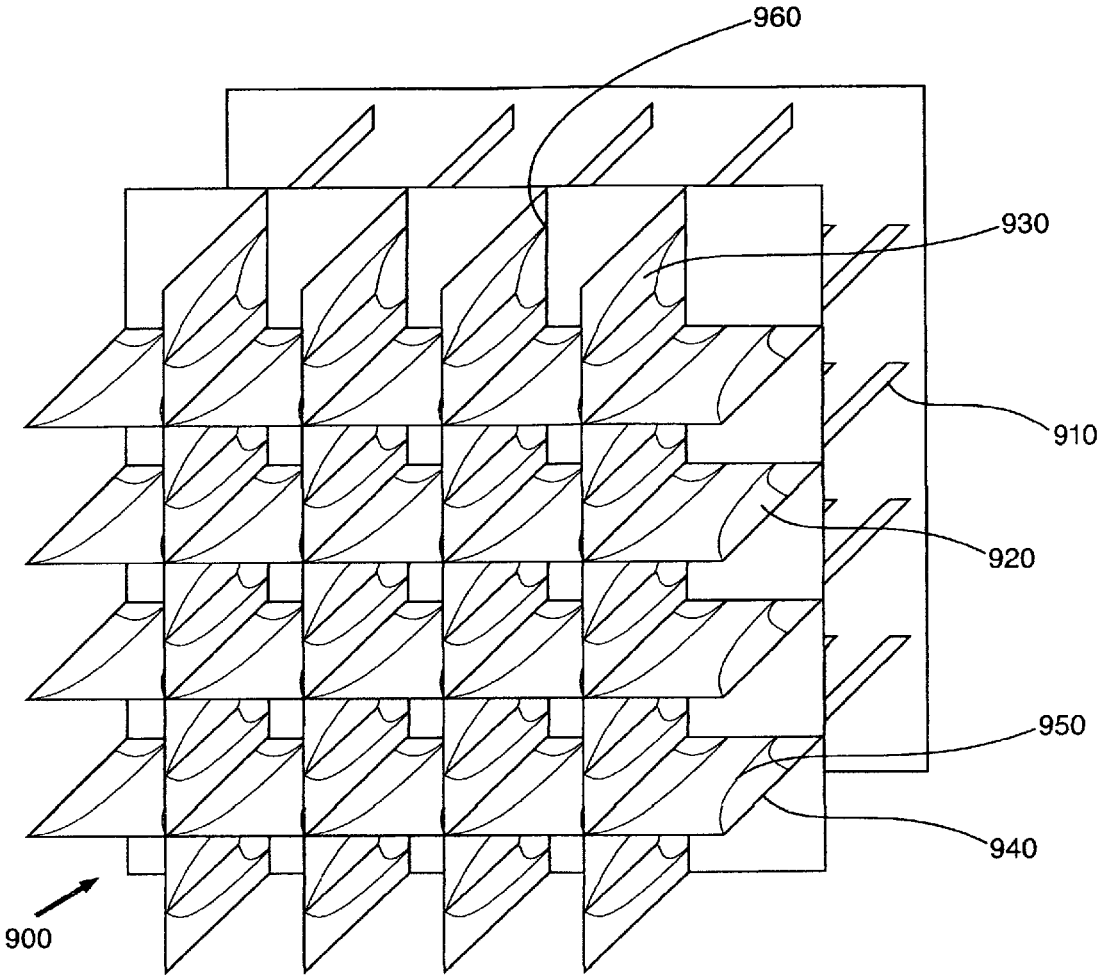
FIGS. 13A-13B show isometric views of an ultra-wide band phased array of the present invention.
Figure 13B:
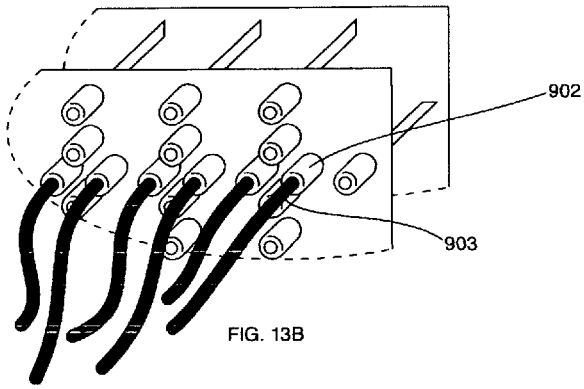

Referring to FIG. 13A, an isometric view of the invention, is shown. The PCB is laminated with copper, for example 920 and 930, on the substrate surface. In the alternative, any conductive material could be used. These copper laminations extend the width of the PCB. Each planar horn shape is characterized by a petal having both a straight edge 940 and a convex curved edge 950 that tapers toward the straight edge culminating in a point at the front of the array, and a tail 960 that extends from one side of the petal to the back of the array 900. Although the array might look similar to prior Vivaldi slot arrays, its operation is substantially different. A conventional Vivaldi slot array with elements of this size could not radiate below about 6 GHz. The gain and VSWR performance of the array, of the present invention, are all below 6 GHz; thereby demonstrating the power of the connectedness to lower the frequency response of the array. As shown in FIG. 13A, the tails of the planar horn shapes extend backward, 910. Element 910 end in a SMA edge connector (not shown). In FIG. 13B, the SMA edge connector (not shown) couples with an adapter, 902, that in turn couples with a coaxial feed line, 903. The antenna array, 900, discussed above can radiate both as a vertical polarization array and horizontal polarization array. The boresight gain for horizontal polarization and horizontal cut performance showed that the array directivity increased with higher frequency and there was an absence of backlobes. Further, a time delay scan plate (not shown) installed in the array 900 to steer the beam at 30 degrees, showed that the beam is solidly aligned to the angle regardless of frequency and that the array directivity increased with higher frequency. Another key point is that there are no grating lobe occurrences in the E plane of the array of the invention. Generally, grating lobes are caused by a regular pattern of discrete discontinuities in the E plane. The array of the invention is a connected array, which means that current flows from one feed to an adjacent feed. As a result, no grating lobes occur.

Figure 11:
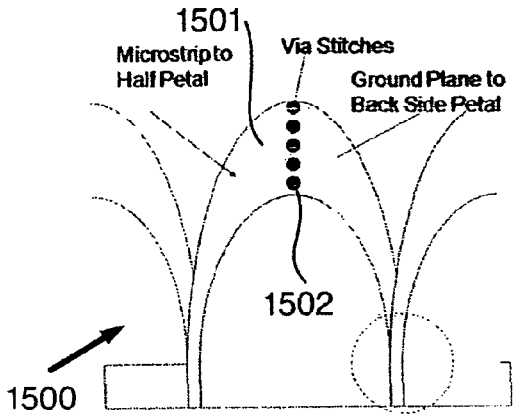
FIG. 11 shows a non-differential (common mode) petal layout.
Figure 14:
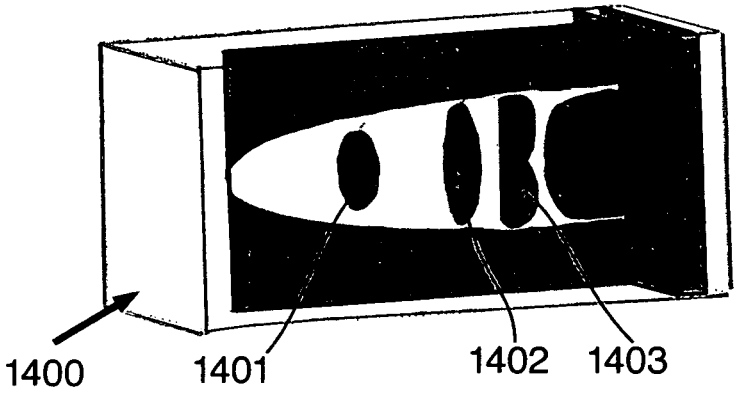
FIG. 14 shows a petal layout with added elliptical holes.

FIG. 11 shows a non-differential (common mode) petal layout 1500. This embodiment is characterized by having petal half portions 1501 being disposed on separate sides of the PCB layout and consequently, stitching the aforementioned petal half portion by means of vias 1502. This preferred embodiment does not require the usage of baluns and provides with an advantageous shorter depth; hence it allows the use of conventional micro-strip, co-planar waveguide or other common mode transmission line structures. Another embodiment of the invention is shown in FIG. 14. Three elliptic holes 1401, 1402, 1403 were put into the petal 1400 in order to eliminate a VSWR dip of −0.8 dB occurring between 1.5 and 2 GHz. Various modifications with varying amount and different aspects of holes were tested to improve the VSWR bump. The most efficient modification was obtained with the addition of a third hole 1403 to petal 1400. While the addition of the third elliptic hole significantly improves the VSWR bump issue, the configuration is merely an exemplary one, and an infinite variety of size and shape hole alternatives might produce very similar VSWR reductions.

In other embodiments, to lower the frequency response of the array without increasing its size high diamagnetic materials can be added to the area between the feeds, artificial magnetic conductors can be used to hide the back plane, resistive and reactive terminations around the periphery can be used. Artificial Magnetic Conductor (AMC)/Electromagnetic Band Gap (EBG) have a unique property that makes them very attractive for some antenna designs: AMC/EBGs can make the back plane to an antenna element disappear. Furthermore, AMCs can make an antenna element smaller by coupling the antenna element to the whole AMC structure. In effect, the AMC backplane then also becomes part of the antenna, the antenna becomes physically larger by coupling its power to the AMC backplane which is bigger than the antenna element. The AMC/EBGs backplane can be dielectrically and/or magnetically loaded. This opens significant flexibility for significant reduction of the electrical size of the element and the AMC, with a corresponding reduction in the lowest frequency that can be supported by the design. The obvious advantage provided by the UWB AMC/EBG backplane is that it can be made to electrically disappear with respect to element backplane interaction, while shielding other elements or devices behind the backplane. The AMC/EBG backplane also allows the array to become very physically thin as compared to wavelengths employed.

On another embodiment of the invention, an OTH dual polarization array is obtained by choosing a preferred impedance and design an array to match it with using the aspect ratio explained above. According to previous art teachings, over-the-horizon (OTH) radars are usually utilized to detect moving objects at very long ranges, which impart Doppler frequencies to the reflections corresponding to the velocity and acceleration characteristics of the targets. The received signals cover a range of Doppler frequencies starting at zero Hz. Additionally, OTH radars are notorious because they operate at such low frequencies that the size of the antenna needs to be very large in order for the antenna to be operable. Because of the very large sizes needed to obtain an operable antenna, existing OTH radars are not constructed to perform dual polarization radiation. The OTH dual polarization array of the embodiment is very similar to the previously explained array, but uses more straight wire segments, instead of the planar hornlette configuration, and a screen backplane. Resonance-related issues on the OTH dual polarization array are controlled by means of appropriately designed filter traps at some or in between some of the feeds; this approach dampens the resonances and keeps them from affecting the VSWR.

In other alternatives, any multiple of 377 ohms can be used as the antenna element impedance. Many widely different embodiments of the present invention may be constructed without departing from the spirit and scope of the present invention. It should be understood that the present invention is not limited to the specific embodiments described in the specification, except as defined in the appended claims.

What is claimed is:

1. A method for at least one of emitting and receiving RF signals comprising:

providing a plurality of electromagnetically (EM) reactive elements, each EM reactive element having an RF feedpoint, each RF feedpoint comprising a source terminal for a source of current for said RF signals and an RF sink terminal for providing a current sink for said RF signals, arranging said plurality of EM reactive elements in a two dimensional array wherein each said source terminal of a respective said EM reactive element is electrically coupled to said sink terminal of a next adjacent, in one direction, co-linear said EM reactive element, so that an emitted or received EM field associated with said co-linear reactive elements is co-polarized, and also wherein each said sink terminal of a respective said EM reactive element is electrically coupled to said source terminal of a next adjacent, in an opposite direction, co-linear said reactive element, defining an electric vector field plane (E-plane) that is substantially co-linear with a next adjacent co-linear coupling between said EM reactive elements, said E-plane further creating a magnetic vector field plane (H-plane) that is substantially perpendicular to said E-plane, defining a unit cell as an area surrounding at least one said RF feedpoint of a respective said EM reactive element, with a perimeter of said unit cell being co-planar to a plane of said array, with perimeters of said unit cells generally bisecting a distance between said RF feedpoints in said E-plane direction and in said H-plane direction, selecting a ratio of spacings between said RF feedpoints in said array to define a predetermined aspect ratio of electrical vector fields (E fields) to magnetic vector fields (H fields) developed by each said reactive element of said EM reactive elements, said predetermined aspect ratio of spacing between said E-plane and said H-plane of each of said EM reactive elements selected to impress a free space wave impedance of said unit cells of said array onto said RF feedpoints in order to closely match a convenient impedance of each feed network port attached to each said feed point without need of other impedance matching aids, using said array to efficiently perform at least one of said emitting and receiving said RF signals.

2. The method as set forth in claim 1 wherein said selecting a ratio of spacing between RF feedpoints in said array to define said predetermined aspect ratio further comprises, for each said EM reactive element, developing said magnetic fields that are larger than corresponding electrical fields within each said unit cell to provide a feed point impedance that is in inverse relation to size of said magnetic field.

3. The method as set forth in claim 2 wherein said developing magnetic fields that are larger than corresponding said electrical fields further comprises sizing said magnetic fields to be at least twice as large as said electrical fields within each said unit cell, reducing an impedance impressed on a respective said feedpoint of said array by at least half.

4. The method as set forth in claim 1 wherein said arranging said plurality of EM reactive elements in an array further comprising arranging said plurality of EM reactive elements in a plurality of electrically coupled rows, each said row substantially parallel to each other and substantially mutually co-planar.

5. The method as set forth in claim 4 wherein said arranging said plurality of EM reactive elements in a plurality of electrically coupled rows further comprises, for each said row of EM reactive elements and corresponding row of said feedpoints, arranging each said source terminal and each said sink terminal of each said row of feedpoints so that current through each said RF reactive element in a respective said row flows in the same direction, providing at least one of emitting and receiving first co-polarized said RF signals.

6. The method as set forth in claim 4 wherein said arranging said EM reactive elements in a plurality of electrically coupled rows further comprises arranging other EM reactive elements of said array in generally parallel planes other than said rows, for said at least one of emitting and receiving RF signals in a second co-polarized polarization.

7. The method as set forth in claim 6 wherein said arranging other EM reactive elements of said array in generally parallel planes other than said rows further comprises arranging said other EM reactive elements of said array in generally parallel planes other than said rows comprises arranging said others of said parallel planes in orthogonal directions to said rows so that orthogonal dual polarized said ultrawideband RF signals are at least one of emitted and received.

8. The method as set forth in claim 4 wherein said arranging said EM reactive elements in planes of said EM reactive elements further comprises arranging said planes of EM reactive elements in conformal planes.

9. The method as set forth in claim 4 wherein said selecting a spacing between said RF feedpoints in said array further comprises selecting a uniform spacing between said RF feedpoints so that said predetermined aspect ratio is the same for all said EM reactive elements of said array.

10. The method as set forth in claim 4 wherein said selecting a spacing between said RF feedpoints in said array further comprises selecting a non-uniform spacing between said RF feedpoints in said array, so that said aspect ratio is non-uniform across said array, resulting in a non-uniform aspect ratio across said array.

11. The method as set forth in claim 1 further comprising providing a backplane behind said array, said backplane being substantially coplanar with said array, said backplane selected from one of an RF absorptive backplane, a reflective RF backplane, a magnetic backplane of a metamaterial.

12. The method as set forth in claim 4 wherein said providing a plurality of electromagnetically (EM) reactive elements further comprises;

providing a first plurality of EM reactive elements, each EM reactive element of said first plurality of EM reactive elements having a first said RF feedpoint comprising a first RF source terminal and a first RF sink terminal, orienting said first plurality of EM reactive elements in said plane so that each said first RF source terminal is alternated with each said first RF sink terminal, providing a second plurality of EM reactive elements oriented in antipodal relation with said first plurality of EM reactive elements, each EM reactive element of said second plurality of EM reactive elements having a second RF source terminal and a second RF sink terminal, orienting said second plurality of EM reactive elements so that each said second RF source terminal is alternated with a said second RF sink terminal, providing a dielectric between said first plurality of conductive RF antenna elements and said second plurality of conductive RF antenna elements, orienting said first RF feedpoints directly opposite from said second RF sinks, and orienting said first RF sinks directly opposite said second RF feedpoints, with said dielectric therebetween, applying said RF signals to said first plurality of conductive RF antenna elements and said second plurality of conductive RF antenna elements, creating respective electrical fields of opposite polarity along said first plurality of conductive antenna elements and said second plurality of conductive antenna elements, with resulting magnetic fields established by said respective electrical fields being wider than said spacing between said RF feedpoints and said RF sinks, thereby reducing impedance of said array.

13. The method as set forth in claim 12 further comprising:

providing a plurality of coaxial connectors for said array, one coaxial connector for one of each of said first plurality of RF feedpoints, connecting a source terminal of each said first RF feedpoint to a center conductor of a respective said coaxial connector, and connecting a sink terminal of a respective said second RF feed point positioned adjacent and to one side of said first RF feedpoint to an outer conductor of said respective coaxial connector, so that a same RF signal is passed by said first conductive antenna element and said second conductive antenna element in opposite directions and in antipodal relation between said center conductor of said respective coaxial connector attached to said source terminal of said first feedpoint and said outer conductor attached to said sink terminal of said second feedpoint.

14. A method for at least one of emitting and receiving RF signals comprising:

providing a plurality of electromagnetically (EM) reactive elements, each EM reactive element having an RF feedpoint, each said RF feedpoint comprising a source terminal for a source of current for said RF signals and an RF sink terminal for providing a current sink for said RF signals, arranging said plurality of EM reactive elements in a two dimensional array wherein each said source terminal of a respective said EM reactive element is electrically coupled to said sink terminal of a next adjacent, in one direction, to emit or receive a copolarized EM field from or to said co-linear said EM reactive element, so that an emitted or received EM field associated with respective co-linear said reactive elements is polarized along said electrically coupled source terminals and sink terminals, and associated said EM reactive elements and their said one direction, forming a connected array, defining an electric vector field plane (E-plane) that is substantially co-linear with said co-linear EM reactive elements, said E-plane developing a magnetic vector field plane (H-plane) that is substantially perpendicular to said E-plane, defining a unit cell as an area surrounding at least one said RF feedpoint of a respective said EM reactive element, each said unit cell being co-planar to a plane of said array, with two sides of said perimeter of each said unit cell generally bisecting a distance between two or more said RF feedpoints in an E-plane direction and two other orthogonal sides of said perimeter in an H-plane direction, each said unit cell defining a predetermined aspect ratio of said electrical vector field (E field) to said magnetic vector field (H field) developed by each said unit cell by selecting a predetermined spacing between said RF feedpoints in said electrical vector field (E field) direction and said magnetic vector field (H field) direction of each said unit cell, said predetermined spacing selected so that each said unit cell closely matches a convenient impedance of an RF network attached to each said RF feed point without need of other impedance matching aids, using said array to efficiently perform at least one of said emitting and receiving said RF signals.

* * * * *